US008950322B2

(12) United States Patent
Liu et al.

(10) Patent No.: US 8,950,322 B2
(45) Date of Patent: Feb. 10, 2015

(54) EVAPORATIVE SYSTEMS AND METHODS FOR DAMPENING FLUID CONTROL IN A DIGITAL LITHOGRAPHIC SYSTEM

(75) Inventors: Chu-heng Liu, Penfield, NY (US); Peter Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 163 days.

(21) Appl. No.: 13/426,209

(22) Filed: Mar. 21, 2012

(65) Prior Publication Data

US 2013/0247787 A1 Sep. 26, 2013

(51) Int. Cl.
*B41F 7/24* (2006.01)
*B41N 3/08* (2006.01)

(52) U.S. Cl.
USPC ..... 101/147; 101/148; 101/451

(58) Field of Classification Search
CPC ..... B41N 3/08; B41F 7/24; B41F 7/26; B41F 7/28; B41F 7/30; B41F 7/32; B41F 33/0054; B41C 1/1033
USPC ..... 101/147, 148, 451
See application file for complete search history.

(56) References Cited

U.S. PATENT DOCUMENTS

| | | | | |
|---|---|---|---|---|
| 3,741,118 | A | 6/1973 | Carley | |
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge | |
| 5,067,404 | A | 11/1991 | Frunder et al. | |
| 5,701,815 | A | 12/1997 | Bocko | |
| 5,855,173 | A | 1/1999 | Chatterjee et al. | |
| 6,125,756 | A | 10/2000 | Nussel et al. | |
| 6,145,437 | A * | 11/2000 | Bock et al. | 101/349.1 |
| 6,146,798 | A | 11/2000 | Bringans et al. | |
| 6,318,264 | B1 | 11/2001 | D'Heureuse et al. | |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |

(Continued)

FOREIGN PATENT DOCUMENTS

| | | |
|---|---|---|
| DE | 101 60 734 A1 | 7/2002 |
| DE | 103 60 108 A1 | 7/2004 |

(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).

(Continued)

*Primary Examiner* — Blake A Tankersley
(74) *Attorney, Agent, or Firm* — Ronald E. Prass, Jr.; Prass LLP

(57) ABSTRACT

A system and corresponding methods are disclosed for controlling the thickness of a layer of dampening fluid applied to a reimageable surface of an imaging member in a variable data lithography system. Following deposition of the dampening fluid layer, a gas is passed over a region of the fluid layer prior to pattern forming. The gas causes a controlled amount of the dampening fluid layer to evaporate such that the remaining layer is of a desired and controlled thickness. Among other advantages, improved print quality is obtained.

14 Claims, 5 Drawing Sheets

(56) References Cited

U.S. PATENT DOCUMENTS

| | | | | |
|---|---|---|---|---|
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 2003/0167950 | A1 | 9/2003 | Mori | |
| 2004/0011234 | A1 | 1/2004 | Figov | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0223240 | A1 | 9/2008 | Drury | |
| 2009/0266258 | A1 * | 10/2009 | Reichelsheimer et al. | 101/487 |
| 2010/0031838 | A1 | 2/2010 | Lewis et al. | |
| 2011/0048257 | A1 * | 3/2011 | Burke et al. | 101/104 |

FOREIGN PATENT DOCUMENTS

| | | | | |
|---|---|---|---|---|
| DE | 10 2006 050744 | A1 | 4/2008 | |
| DE | 10 2008 062741 | | 7/2010 | |
| EP | 1 935 640 | A2 | 6/2008 | |
| EP | 1 938 987 | A2 | 7/2008 | |
| EP | 1 964 678 | A2 | 9/2008 | |
| EP | 11187189.3 | | 2/2012 | |
| EP | 11187192.7 | | 2/2012 | |
| EP | 11187193.5 | | 2/2012 | |
| EP | 11187190.1 | | 3/2012 | |
| EP | 11187191.9 | | 3/2012 | |
| EP | 11187195.0 | | 4/2012 | |
| EP | 11187196.8 | | 4/2012 | |
| WO | WO-9736746 | * | 10/1997 | B41F 7/24 |
| WO | 2006/133024 | A2 | 12/2006 | |
| WO | WO 2009025821 | A1 | 2/2009 | |

OTHER PUBLICATIONS

Katano et al., "The New Printing System Using the Materials of Reversible Change of Wettability", International Congress of Imaging Science 2002, Tokyo, pp. 297 et seq. (2002).

Kjelgaard, M., "Humidification Side by Side", Engineered Systems Mag., (Troy, MI 2002).

Turpin, Joanna, "Ultrasonic Humidification is Ultra-Efficient", Engineered SYstems Mag., (Troy, MI 2003).

U.S. Appl. No. 13/095,714, filed Apr. 27, 2011, Stowe et al.
U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, filed Aug. 5, 2011, Stowe et al.
U.S. Appl. No. 13/204,526, filed Aug. 5, 2011, Stowe et al.
U.S. Appl. No. 13/204,548, filed Aug. 5, 2011, Stowe et al.
U.S. Appl. No. 13/204,560, filed Aug. 5, 2011, Pattekar et al.
U.S. Appl. No. 13/204,567, filed Aug. 5, 2011, Stowe et al.
U.S. Appl. No. 13/204,578, filed Aug. 5, 2011, Stowe et al.
U.S. Appl. No. 13/366,947, filed Feb. 6, 2012, Biegelsen.
U.S. Appl. No. 13/426,262, filed Mar. 21, 2012, Liu et al.

* cited by examiner

EVAPORATIVE SYSTEMS AND METHODS FOR DAMPENING FLUID CONTROL IN A DIGITAL LITHOGRAPHIC SYSTEM

BACKGROUND

The present disclosure is related to marking and printing methods and systems, and more specifically to methods and systems for precisely metering a dampening fluid (such as a water-based fountain fluid) in a variable lithography marking or printing system.

Offset lithography is a common method of printing. (For the purposes hereof, the terms "printing" and "marking" are used interchangeably.) In a typical lithographic process the surface of a print image carrier, which may be a flat plate, cylinder, belt, etc., is formed to have "image regions" of hydrophobic and oleophilic material, and "non-image regions" of a hydrophilic material. The image regions correspond to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based dampening fluid (commonly referred to as a fountain solution, and typically consisting of water and a small amount of alcohol as well as other additives and/or surfactants). The hydrophobic regions repel dampening fluid and accept ink, whereas the dampening fluid formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Sufficient pressure is used to transfer the image from the offset cylinder to the substrate. Pinching the substrate between the offset cylinder and an impression cylinder provides this pressure.

The above-described lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. However, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image. Ideally, the desire is to incur the same low cost per copy of a long offset or lithographic print run (e.g., more than 100,000 copies), for medium print run (e.g., on the order of 10,000 copies), and short print runs (e.g., on the order of 1,000 copies), ultimately down to a print run length of 1 copy (i.e., true variable data printing).

One problem encountered is that the viscosity of offset inks are generally too high (often well above 50,000 cps) to be useful in nozzle-based inkjet systems. In addition, because of their tacky nature, offset inks have very high surface adhesion forces relative to electrostatic forces and are therefore almost impossible to manipulate onto or off of a surface using electrostatics. (This is in contrast to dry or liquid toner particles used in xerographic/electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser is used to pattern-wise evaporate a dampening fluid.

In another example disclosed in U.S. Pat. No. 7,191,705, incorporated herein by reference, a hydrophilic coating is applied to an imaging belt. A laser selectively heats and evaporates or decomposes regions of the hydrophilic coating. A water based dampening fluid is then applied to these hydrophilic regions, rendering them oleophobic. Ink is then applied and selectively transfers onto the plate only in the areas not covered by dampening fluid, creating an inked pattern that can be transferred to a substrate. Once transferred, the belt is cleaned, a new hydrophilic coating and dampening fluid are deposited, and the patterning, inking, and printing steps are repeated, for example for printing the next batch of images.

In the aforementioned lithographic systems it is very important to have an initial layer of dampening fluid that is of a uniform and desired thickness. To accomplish this, a form roller nip wetting system, which comprises a roller fed by a solution supply, is brought proximate the reimageable surface. Dampening fluid is then transferred from the form roller to the reimageable surface. However, such a system relies on the mechanical integrity of the form roller and the reimageable surface, the surface quality of the form roller and the reimageable surface, the rigidity of the mounting maintaining spacing between the form roller and the reimageable surface, and so on to obtain a uniform layer. Mechanical alignment errors, positional and rotational tolerances, and component wear each contribute to variation in the roller-surface spacing, resulting in deviation of the dampening fluid thickness from ideal.

Furthermore, an artifact known as ribbing instability in the roll-coating process leads to a non-uniform dampening fluid layer thickness. This variable thickness manifests as streaks or continuous lines in a printed image.

Still further, while great efforts are taken to clean the roller after each printing pass, in some systems it is inevitable that contaminants (such as ink from prior passes) remain on the reimageable surface when a layer of dampening fluid is applied. The remaining contaminants can attach themselves to the form roller that deposits the dampening fluid. The roller may thereafter introduce image artifacts from the contaminants into subsequent prints, resulting in an unacceptable final print.

In addition, cavitation may occur on the form roller in the transfer nip due to Taylor instabilities (see, e.g., "An Outline of Rheology in Printing" by W. H. Banks, in the journal Rheologica Acta, pp. 272-275 (1965)), incorporated herein by reference. To avoid these instabilities, systems have been designed with multiple rollers that move back and forth in the axial direction while also moving in rolling contact with the form roller, to break up the rib and streak formation. However, this roller mechanism adds delay in the "steadying out" of the dampening system so printing cannot start until the dampening fluid layer thickness has stabilized on all the roller surfaces. Also, on-the-fly dampening fluid flow control is not possible since the dampening fluid layer is at that point already built up on the form roller and the other dampening system rollers acts as a buffering mechanism.

Accordingly, efforts have been made to develop systems to deposit dampening fluid directly on the offset plate surface as opposed to on intermediate rollers or a form roller. One such system sprays the dampening fluid onto the reimageable offset plate surface. See, e.g., U.S. Pat. No. 6,901,853 and U.S. Pat. No. 6,561,090. However, due to the fact that these dampening systems are used with conventional (pre-patterned) offset plates, the mechanism of transfer of the dampening fluid to the offset plate includes a 'forming roller' that is in rolling contact with the offset plate cylinder to transfer the FS to the plate surface in a pattern-wise fashion—since it is the nip action of contact rolling between the form roller and the patterned offset plate surface that squeezes out the fountain solution from the hydrophobic regions of the offset plate, allowing the subsequent ink transfer selectivity mechanism to work as desired.

While these spray dampening systems provide the advantage of metering the flow rate of the dampening fluid through control of the spray system, as well as the ability to manipulate the dampening fluid layer thickness on-the-fly as needed, the requirement of using the dampening system form roller as the final means of transferring the dampening fluid to the plate surface reintroduces the disadvantages of thickness variation, roller contamination, roller cavitation, and so on. Furthermore, while the dampening fluid is typically less than one micron in thickness, such systems are not able to accommodate a relatively wide thickness range of the dampening fluid in this less-than-one micron regime.

For further reference, additional methods of applying dampening fluid to a reimageable surface are disclosed in U.S. patent application Ser. No. 13/204,515, filed on Aug. 5, 2011, which is incorporated herein by reference.

SUMMARY

The present disclosure is directed to systems and methods for applying a dampening fluid directly to a reimageable surface of a variable data lithographic system. Selective evaporation of the dampening fluid is then performed to arrive at a desired dampening fluid layer thickness.

Initially, systems and methods are employed to form a dampening fluid layer. Such systems and methods may be virtually any conventional system such as the aforementioned form roller, spray or similar direct application, or other known system and method. The layer of dampening fluid is initially deposited to a thickness greater than the ultimate target thickness. A controlled gas flow is applied over the as-deposited dampening fluid to evaporate a desired amount of the dampening fluid to thereby obtain a desired thickness. A thickness sensor may be associated with the gas flow controller to provide near-real time feedback for precise layer thickness control.

An evaporative thickness control subsystem disclosed herein therefore includes a gas source and a nozzle or array of nozzles for directing the gas from the source to the surface of the dampening fluid over the reimageable surface (gas jet embodiments) or from the source over the surface of the dampening fluid and into the nozzle (vacuum embodiments). Other elements of the evaporative thickness control subsystem may include a pressure source to provide transport pressure to the evaporative gas, a vacuum extraction subsystem for collecting the evaporated dampening fluid, a recycling system for recycling the collected evaporated dampening fluid, shielding elements to prevent evaporated dampening fluid from settling on other subsystems or system components, a dampening fluid thickness measurement subsystem, and controller for controlling various aspects of the conditions (such as the gas flow rate, temperature, and so on) leading to dampening fluid evaporation (optionally responsive to the dampening fluid thickness measurement subsystem).

Various embodiments of an evaporative thickness control subsystem are contemplated herein, which include a plurality of the above-mentioned elements. For example, according to a first embodiment, a gas flow is directed to an open region of the dampening fluid surface uniformly across the width of the reimageable surface. According to a second embodiment, a manifold is positioned over the reimageable surface to define a gap. The evaporative gas is directed into the gap such that evaporation occurs predominantly in the gap. Either the first or second embodiments may operate with a positive gas flow through the nozzle (gas jet embodiments) or a negative gas flow through the nozzle (vacuum embodiments). Evaporation rates may be controlled by controlling the gas flow rate, distance between the gas source and the reimageable surface, the temperature of the gas, the humidity of the gas, the temperature of the reimageable surface (or plate or drum thereunder), the exposure time or distance of the dampening fluid to the gas, and so on.

Various feedback and control systems may be provided to measure the thickness of the layer of dampening fluid applied to the reimageable surface, and control, dynamically or otherwise, aspects of the evaporation process to obtain and maintain a desired layer thickness.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment, and other established details are merely summarized or are omitted so as not to unnecessarily obscure the details of the present invention. Thus, where details are otherwise well known, we leave it to the application of the present invention to suggest or dictate choices relating to those details.

Figure 1:
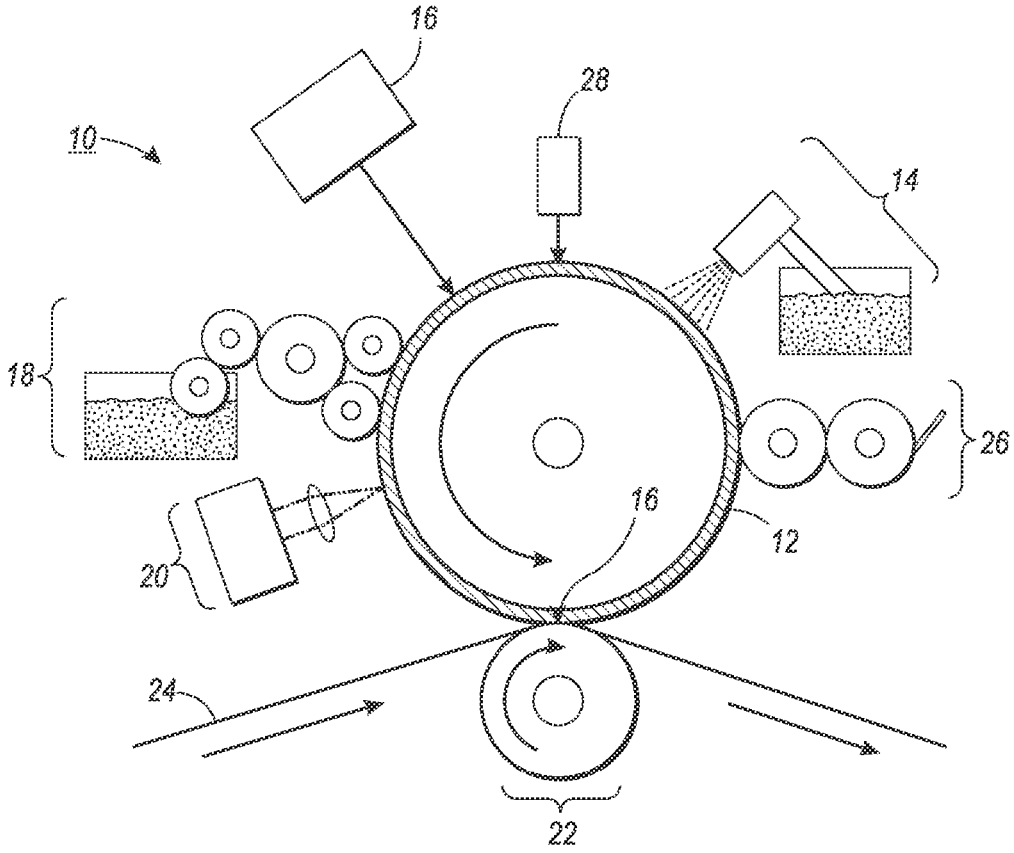
FIG. 1 is a side view of a system for variable lithography according to an embodiment of the present disclosure.

With reference to FIG. 1, there is shown therein a system 10 for variable data lithography according to one embodiment of the present disclosure. System 10 comprises an imaging member 12, in this embodiment a drum, but may equivalently be a plate, belt, etc., surrounded by a direct-application dampening fluid subsystem 14 (although other than direct application subsystems may also be used), an optical patterning subsystem 16, an inking subsystem 18, a rheology (complex viscoelastic modulus) control subsystem 20, transfer subsystem 22 for transferring an inked image from the surface of imaging member 12 to a substrate 24, and finally a surface cleaning subsystem 26. Many optional subsystems may also be employed, but are beyond the scope of the present disclosure. Many of these subsystems, as well as operation of the system as a whole, are described in further detail in the U.S. patent application Ser. No. 13/095,714, which is incorporated herein by reference.

The key requirement of dampening fluid subsystem 14 is to deliver a layer of dampening fluid having a relatively uniform and controllable thickness over a reimageable surface layer over imaging member 12. In one embodiment this layer is in the range of 0.1 μm to 1.0 μm. Due to a variety of causes, this layer may vary in thickness from location to location. Furthermore, given the control of certain deposition subsystems, this layer may be within 0.1 or more microns of the desired target thickness. Therefore, an additional mechanism is required to refine the thickness of the dampening fluid layer prior to optical patterning subsystem 16. The evaporative thickness control subsystem 28 serves this purpose, and is disclosed in further detail below.

The dampening fluid must have the property that it wets and thus tends to spread out on contact with the reimageable surface. Depending on the surface free energy of the reimageable surface the dampening fluid itself may be composed mainly of water, optionally with small amounts of isopropyl alcohol or ethanol added to reduce its natural surface tension as well as lower the evaporation energy necessary for subsequent laser patterning. In addition, a suitable surfactant may be added in a small percentage by weight, which promotes a high amount of wetting to the reimageable surface layer. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally the dampening fluid may contain a radiation sensitive dye to partially absorb laser energy in the process of patterning. Optionally the dampening fluid may be non-aqueous consisting of, for example, silicone fluids, polyfluorinated ether or fluorinated silicone fluid.

In the description of embodiments that follow it will be appreciated that as there is no pre-formed hydrophilic-hydrophobic pattern on a printing plate in system 10. A laser (or other radiation source) is used to form pockets in, and hence pattern, the dampening fluid. The characteristics of the pockets (such as depth and cross-sectional shape), which determine the quality of the ultimate printed image, are in large part a function of the effect that the laser has on the dampening fluid. This effect is to a large degree influenced by the thickness of the dampening fluid at the point of incidence of the laser. Therefore, to obtain a controlled and preferred pocket shape, it is important to control and make uniform the thickness of the dampening fluid layer, and to do so without introducing unwanted artifacts into the printed image.

Figure 2:
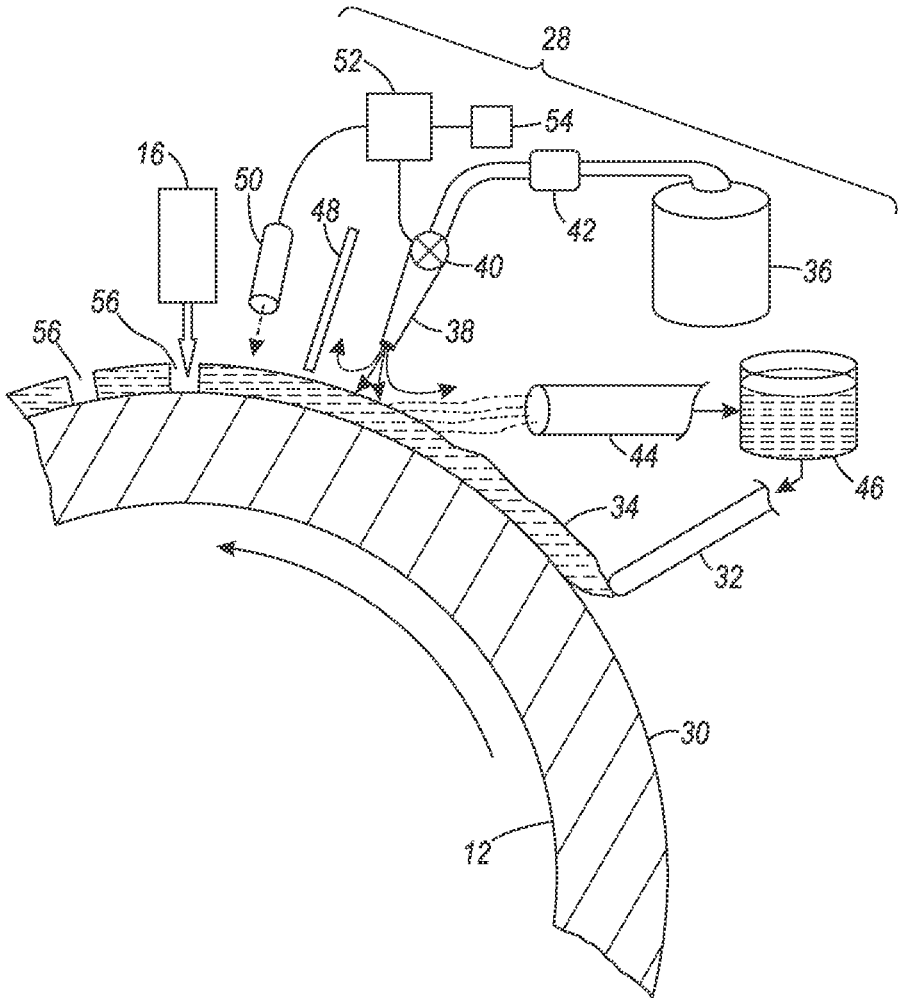
FIG. 2 is a side view of a portion of a system for variable lithography including an evaporative thickness control subsystem according to an embodiment of the present disclosure.

Accordingly, with reference to FIG. 2, there is shown therein an evaporative thickness control subsystem 28 according to a first embodiment of the present disclosure. Evaporative thickness control subsystem 28 is disposed proximate an imaging member 12 having a reimageable surface 30. A dampening fluid deposition subsystem 32 initially deposits a layer of dampening fluid 34 over surface 30. Layer 34 may in the range of 0.2 μm to 1.0 μm as deposited. Evaporative thickness control subsystem 28 is disposed following fluid deposition subsystem 32 in the direction of motion of imaging member 12. Evaporative thickness control subsystem 28 comprises an evaporative gas source 36, which may be a canister or tank (as shown), a gas generation device, an inlet port for collecting ambient gas (such as air, remote from the region of the reimageable surface), or other appropriate source structure. A gas-directing nozzle 38, or an array of such nozzles, is connected to evaporative gas source 36 by way of a valve 40 and optional pressure source 42 to provide transport pressure to the evaporative gas.

In operation, evaporative gas from source 36 is forced from nozzle 38 towards the surface of layer 34. This causes evaporation of a portion of layer 34. Dampening fluid evaporated from layer 34 may form part of the ambient air surrounding the lithographic system, or may be removed from the proximity of layer 34 by a vacuum extraction subsystem 44. In certain embodiments, extracted dampening fluid may be recycled, stored in a reservoir 46, and reused by dampening fluid deposition subsystem 32.

According to certain embodiments, evaporative gas from source 36 forced from nozzle 38 is incident on layer 34 generally radially relative to the surface of imaging member 12. In other embodiments, the evaporative gas may be directed against the direction of rotation of imaging member 12 (i.e., directed upstream). In still other embodiments, the evaporative gas may be directed with the direction of rotation of imaging member 12 (i.e., directed downstream). The choice of direction will depend on the particular application, but considerations include possible affects on the downstream layer thickness and other subsystems and elements located downstream of evaporative thickness control subsystem 28.

One level of control of the extent of evaporation resulting from the direction of gas onto the surface of layer 34 by evaporative thickness control subsystem 28 may be provided by controlling the gas flow rate, the distance between the exit port of nozzle 38 and the reimageable surface, the temperature of the gas, the humidity of the gas, the temperature of the ambient, the humidity of the ambient, the temperature of the reimageable surface (or plate or drum thereunder), the exposure time or distance of the dampening fluid to the gas, and so on. Therefore, control of layer thickness to a first-order may be determined based on the conditions listed above, and possibly others, given the application of the present disclosure. Higher-order (more precise) control over layer thickness may be provided by a feedback mechanism discussed further below.

One goal of the present disclosure is to provide a system and method for forming a precise dampening fluid layer thickness for accurate patterning by optical patterning subsystem 16. In this regard, it is important that dampening fluid evaporated by evaporative gas exiting nozzle 38 not settle on the surface of layer 34 following evaporative thickness control subsystem 28 in the direction of travel of imaging member 12. It is also important that the gas exiting nozzle 38 not further disturb the surface of layer 34 following evaporative thickness control subsystem 28 in the direction of travel of imaging member 12. Therefore, in addition to vacuum extraction subsystem 44 a barrier structure 48 may be disposed between optical patterning subsystem 16 and evaporative thickness control subsystem 28.

According to certain embodiments of the present disclosure, the thickness of the layer 34 is determined by an appropriate method and system, such as an optical thickness measurement device 50. The measured thickness of layer 34 may be used to confirm that the evaporative thickness control subsystem 28 is operating properly. It may also be used to manually or automatically adjust the operation of evaporative thickness control subsystem 28 to obtain a target thickness for layer 34. In the later case, the output of optical thickness measurement device 50 is provided to a control device 52. Control device 52 compares the thickness measurement from device 50 to a target thickness, and sends an appropriate feedback signal, for example to valve 40 (e.g., a servo-operated valve) if needed to increase or decrease the gas flow to obtain the appropriate thickness of layer 34. Alternatively, or in addition to providing the feedback signal to control device 52, the feedback signal may be provided to a control device 54 for controlling one or more of the following: an apparatus that controls the distance between the exit port of nozzle 38 and the reimageable surface, an apparatus that controls the temperature of the gas, an apparatus that controls the humidity of the gas, an apparatus that controls the temperature of the ambient, an apparatus that controls the humidity of the ambient, an apparatus that controls the temperature of the reimageable surface (or plate or drum thereunder), an apparatus that controls the exposure time or distance of the dampening fluid to the gas, and so on. This feedback loop may operate continuously and sufficiently rapidly that substantially real-time layer thickness control may be provided, to tenths of a micron or greater accuracy.

Figure 3:
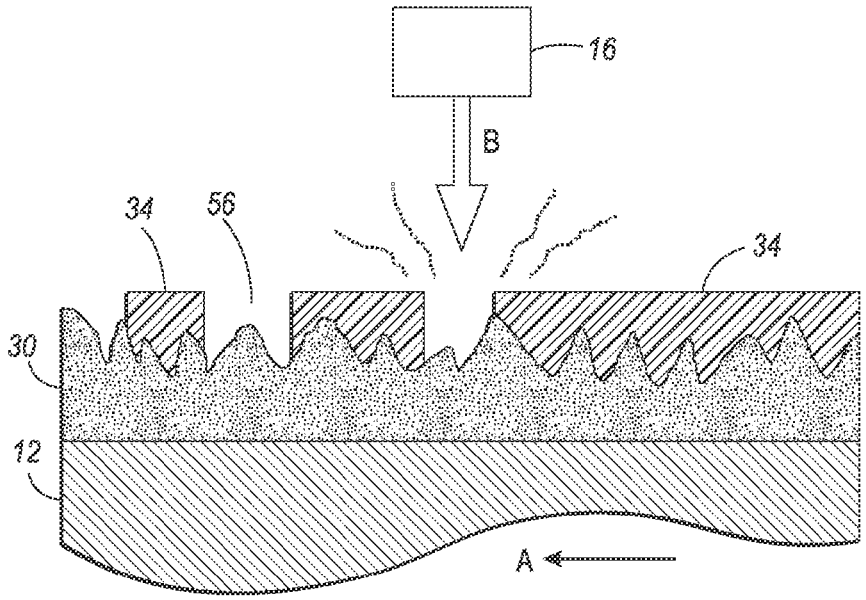
FIG. 3 is a cutaway view of a portion of an imaging member with a patterned dampening fluid layer disposed thereover according to an embodiment of the present disclosure.

Finally, layer 34 is brought past optical patterning subsystem 16, which is used to selectively form an image in the dampening fluid by image-wise evaporating the dampening fluid layer using laser energy, for example. With reference to FIG. 3, which is a magnified view of a region of imaging member 12 and reimageable surface 30 having a layer of dampening fluid 34 applied thereover, the application of optical patterning energy (e.g., beam B) from optical patterning subsystem 16 results in selective evaporation of portions of layer 34. This produces a pattern of ink-receiving wells 56 in the dampening fluid. Relative motion between imaging member 12 and optical patterning subsystem 16, for example in the direction of arrow A, permits a process-direction patterning of layer 34.

Figure 4:
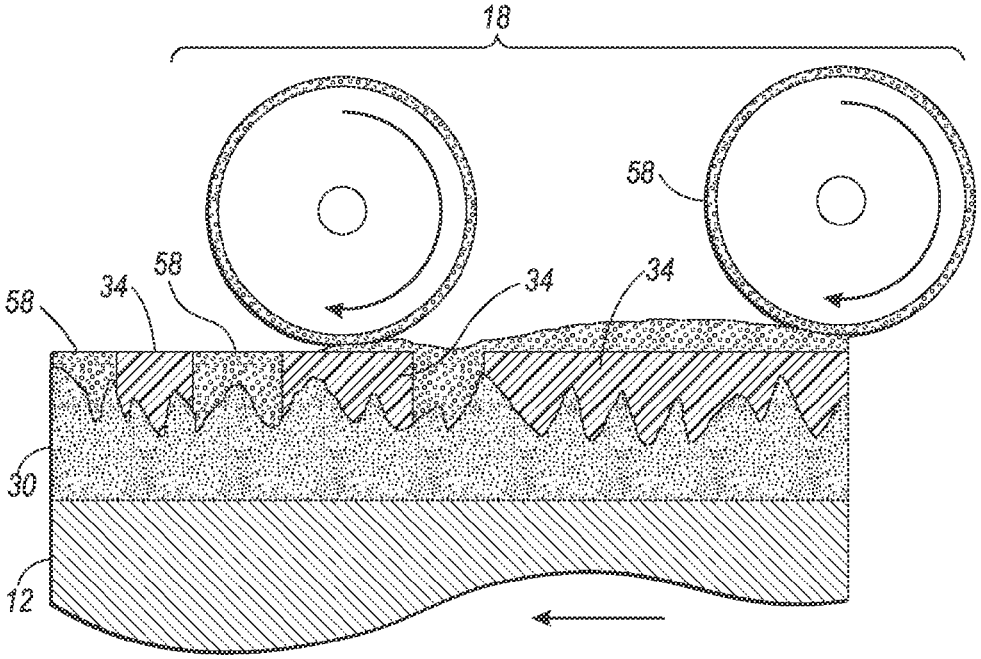
FIG. 4 is a cutaway view of a portion of an imaging member with an inked patterned dampening fluid layer disposed thereover according to an embodiment of the present disclosure.

As shown in FIG. 4, inking subsystem 18 may then provide ink over the surface of layer 30. Due to the nature of the ink, surface 30, dampening fluid comprising layer 34, and the physical arrangements of the elements of the inking subsystem 18, ink selectively fills ink-receiving wells 56 (shown in FIG. 3). By providing a precisely controlled thickness of layer 34, the extent, profile, and other attributes of each ink-receiving well are well controlled, the amount of ink filling each ink-receiving well is controlled, and ultimately the quality of the resulting image applied to the substrate is therefore improved and consistent.

Figure 5:
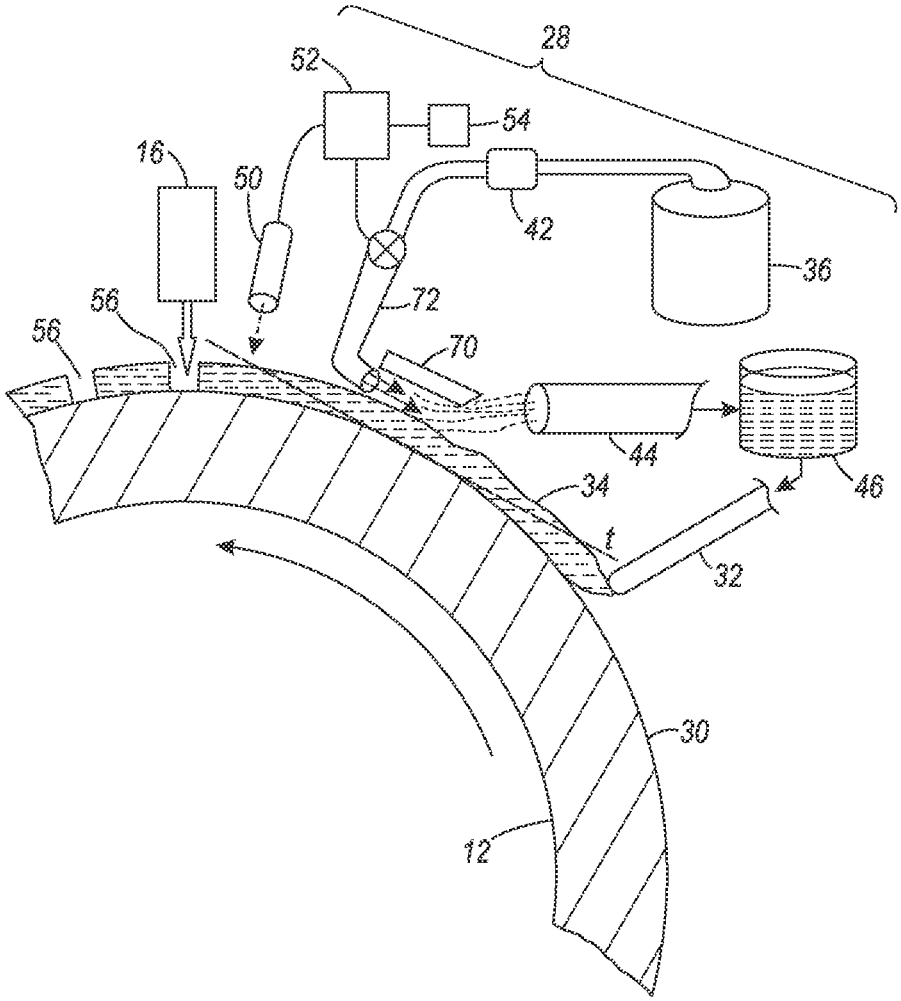
FIG. 5 is a side view of a portion of a system for variable lithography including an evaporative thickness control subsystem according to an alternate embodiment of the present disclosure.

FIG. 5 illustrates another embodiment of the present disclosure. According to this embodiment, a plate structure 70 is provided proximate surface 30 of imaging member 12. Plate structure 70 may be planar and disposed such that its plane is substantially parallel to a tangent line t of imaging member 12, or may be an arch structure with a radius matching and coaxial with the radius of imaging member 12. Nozzle 72 is disposed at one end of plate structure 70, such as the downstream end relative to the direction of travel of imaging member 12. An evaporative gas is exhausted from nozzle 72, in this case against the direction of travel of layer 34. As with the embodiments described above, the evaporative gas causes evaporation of a portion of layer 34. Dampening fluid evaporated from layer 34 may form part of the ambient air surrounding the lithographic system, or may be removed from the proximity of layer 34 by vacuum extraction subsystem 44. In certain embodiments, extracted dampening fluid may be recycled, stored in reservoir 46, and reused by dampening fluid deposition subsystem 32.

Figure 6:
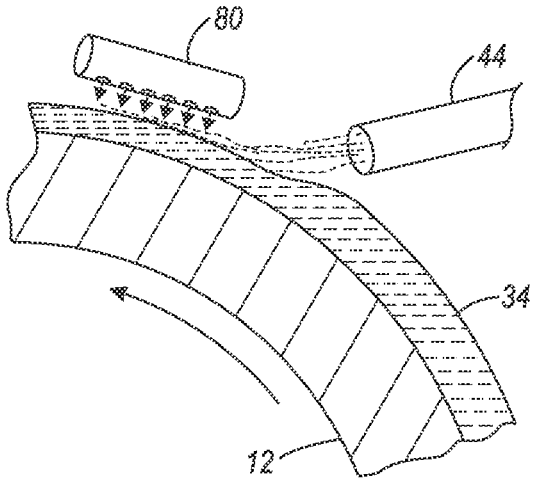
FIG. 6 is a side view of a portion of a system for variable lithography including an evaporative thickness control subsystem according to another alternate embodiment of the present disclosure.

FIG. 6 illustrates yet another embodiment of the present disclosure. According to this embodiment, a manifold is 80 is again provided proximate surface 30 of imaging member 12. However, in place of a separate nozzle, manifold 80 has formed therein a plurality of vents which act as an array of nozzles. Manifold 80 may be connected to a gas source and controlled by a feedback signal substantially as previously described.

Figure 7:
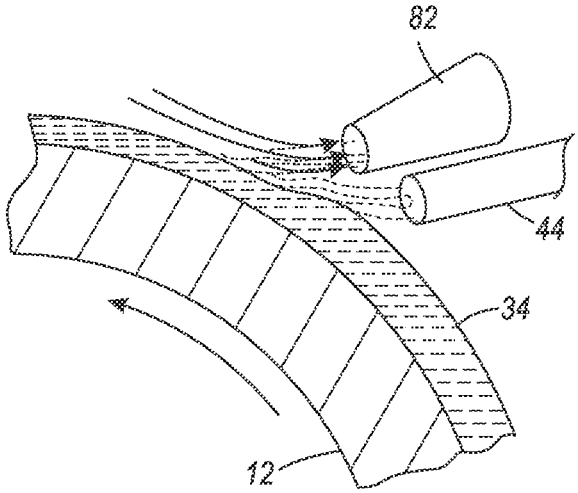
FIG. 7 is a side view of a portion of a system for variable lithography including an evaporative thickness control subsystem according to a still further alternate embodiment of the present disclosure.

It will be appreciated that while each of the above-disclosed embodiments have operated as a nozzle (or array of nozzles) exhausting an evaporative gas in the direction of the dampening fluid layer, with proper adjust of certain parameters and element locations, each of the above embodiments may operate such that a vacuum is the prime mover of gas—i.e., due to application of a vacuum, a gas passes over the surface of the dampening fluid causing evaporation and resultant thickness control. By way of illustration, FIG. 7 shows a nozzle 82 operating in a vacuum configuration. The draw from nozzle 82 causes a gas (specifically introduced or ambient in the region of layer 34) to pass over the surface of layer 34 resulting in evaporation of dampening fluid. The evaporated dampening fluid may travel with the gas into nozzle 82, and/or be otherwise removed by a supplemental extraction system 44 or the like.

No limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. An evaporative thickness control subsystem for controlling the thickness of a dampening fluid layer in a variable data lithography system of the type in which the dampening fluid layer is applied by a dampening fluid subsystem over a reimageable surface of an imaging member, comprising:

a gas source;

a gas-directing nozzle, communicatively coupled to said gas source, configured to be disposed proximate said reimageable surface, and further disposed in a direction of travel of said imaging member following said dampening fluid subsystem and before an optical patterning system for patterning said dampening fluid layer, wherein said gas-directing nozzle configured to direct a gas from said source in a direction toward a surface of said dampening fluid layer such that a portion of said dampening fluid layer may be caused to evaporate to obtain a dampening layer of a desired thickness;

a thickness sensor for determining the thickness of said dampening fluid layer at a location following said gas-directing nozzle; and a barrier structure configured to be disposed between said gas-directing nozzle and said optical patterning subsystem in the direction of travel of said imaging member to prevent evaporated dampening fluid from settling on said dampening fluid layer following evaporation and to otherwise prevent disturbing the dampening fluid layer between the point of evaporation and the optical patterning subsystem.

2. The evaporative thickness control subsystem of claim 1, further comprising a valve disposed between said gas source and said gas-directing nozzle and regulating the flow of gas to said gas-directing nozzle to thereby control the extent of evaporation of said dampening fluid.

3. The evaporative thickness control subsystem of claim 2, further comprising:

a controller communicatively coupled to said thickness sensor and said valve such that said thickness determined by said thickness sensor is compared to a target thickness and in response to said comparison said controller provides a signal to said valve to adjust the flow of said gas to said nozzle to thereby control the extent of evaporation of said dampening fluid;

wherein said controller is communicatively coupled to a control mechanism for actuating, in response to said comparison of said thickness and said target thickness, an apparatus for controlling aspects of the extent of evaporation of said dampening fluid layer selected from the group consisting of:

an apparatus that controls spacing between said gas-directing nozzle and said reimageable surface;

an apparatus that controls a temperature of the gas flowing to and through said gas-directing nozzle;

an apparatus that controls the humidity of the gas flowing to and through said gas-directing nozzle;

an apparatus that controls temperature of an ambient proximate said reimageable surface;

an apparatus that controls humidity of an ambient proximate said reimageable surface;

an apparatus that controls temperature of the reimageable surface; and, an apparatus that controls exposure time of the dampening fluid to the gas exiting said gas-directing nozzle.

4. The evaporative thickness control subsystem of claim 1, wherein said gas source is selected from the group consisting of: a gas generator, and a gas storage container.

5. The evaporative thickness control subsystem of claim 1, wherein said gas is air and said gas source is a region of the ambient remote from said reimageable surface.

6. The evaporative thickness control subsystem of claim 1, further comprising a pressure source communicatively coupled to said gas source and said gas directing nozzle to provide transport pressure to the gas.

7. The evaporative thickness control subsystem of claim 1, further comprising an extraction subsystem for extracting evaporated dampening fluid from a region proximate said dampening fluid layer.

8. The evaporative thickness control subsystem of claim 7, further comprising a reservoir, communicatively coupled to said extraction subsystem, for collecting and recycling evaporated dampening fluid extracted from said region proximate said dampening fluid layer for reuse by said dampening fluid subsystem.

9. An evaporative thickness control subsystem for controlling the thickness of a dampening fluid layer in a variable data lithography system of the type in which the dampening fluid layer is applied by a dampening fluid subsystem over a reimageable surface of an imaging member, comprising:

a gas source;

a gas-directing nozzle, communicatively coupled to said gas source by way of a valve, configured to be disposed proximate said reimageable surface, and further disposed in a direction of travel of said imaging member following said dampening fluid subsystem and before an optical patterning system for patterning said dampening fluid layer, said gas-directing nozzle configured to direct a gas from said source in a direction toward a surface of said dampening fluid layer such that a portion of said dampening fluid layer may be caused to evaporate to obtain a dampening layer of a desired thickness;

a thickness sensor for determining the thickness of said dampening fluid layer at a location following said gas directing nozzle;

a controller communicatively coupled to said thickness sensor and said valve such that said thickness determined by said thickness sensor is compared to a target thickness and in response to said comparison said controller provides a signal that may be used to control the extent of evaporation of said dampening fluid; and a barrier structure configured to be disposed between said gas-directing nozzle and said optical patterning subsystem in the direction of travel of said imaging member to prevent evaporated dampening fluid from settling on said dampening fluid layer following evaporation and to otherwise prevent disturbing the dampening fluid layer between the point of evaporation and the optical patterning subsystem.

10. The evaporative thickness control subsystem of claim 9, wherein said controller is communicatively coupled to a control mechanism for actuating, in response to said comparison of said thickness and said target thickness, an apparatus for controlling aspects of the extent of evaporation of said dampening fluid layer selected from the group consisting of:

an apparatus that controls spacing between said gas-directing nozzle and said reimageable surface;

an apparatus that controls a temperature of the gas flowing to and through said gas-directing nozzle;

an apparatus that controls the humidity of the gas flowing to and through said gas-directing nozzle;

an apparatus that controls temperature of an ambient proximate said reimageable surface;

an apparatus that controls humidity of an ambient proximate said reimageable surface;

an apparatus that controls temperature of the reimageable surface; and, an apparatus that controls exposure time of the dampening fluid to the gas exiting said gas-directing nozzle;

wherein the valve controls the volume of gas that may flow through said nozzle.

11. The evaporative thickness control subsystem of claim 9, further comprising: an extraction subsystem for extracting evaporated dampening fluid from a region proximate said dampening fluid layer; and a reservoir, communicatively coupled to said extraction subsystem, for collecting and recycling evaporated dampening fluid extracted from said region proximate said dampening fluid layer for reuse by said dampening fluid subsystem.

12. A variable data lithography system, comprising:

an imaging member having an arbitrarily reimageable imaging surface;

a dampening fluid subsystem for applying a layer of dampening fluid to said imaging surface;

a patterning subsystem for selectively removing portions of the dampening fluid layer so as to produce an image in the dampening fluid;

an evaporative thickness control subsystem, comprising: a gas source; and a gas-directing nozzle, communicatively coupled to said gas source, disposed proximate said reimageable surface, and further disposed in a direction of travel of said imaging member following said dampening fluid subsystem and before said patterning system, said gas-directing nozzle configured to direct a gas from said source in a direction toward a surface of said dampening fluid layer such that a portion of said dampening fluid layer may be caused to evaporate to obtain a dampening layer of a desired thickness;

a thickness sensor for determining the thickness of said dampening fluid layer at a location following said gas-directing nozzle;

a barrier structure disposed between said gas-directing nozzle and an optical patterning subsystem in the direction of travel of said imaging member to prevent evaporated dampening fluid from settling on said dampening fluid layer following evaporation and to otherwise prevent disturbing the dampening fluid layer between the point of evaporation and the optical patterning subsystem;

an inking subsystem for applying ink over the imaging surface such that said ink selectively occupies regions where dampening fluid was removed by the patterning subsystem to thereby form an inked image;

an image transfer subsystem for transferring the inked image to a substrate; and a cleaning subsystem for removing residual ink and dampening fluid from the reimageable imaging surface.

13. A subsystem for controlling the thickness of a dampening fluid layer in a variable data lithography system of the type in which the dampening fluid layer is applied by a dampening fluid subsystem over a reimageable surface of an imaging member, comprising:

a dampening fluid reservoir configured to provide said dampening fluid to said reimageable surface;

a gas source;

a gas-directing nozzle, communicatively coupled to said gas source by way of a valve, to direct a gas from said gas source in a direction toward a surface of said dampening fluid layer such that a portion of said dampening fluid layer may be caused to evaporate to obtain a dampening layer of a desired thickness;

a pressure source communicatively coupled to said gas source and said gas directing nozzle to provide transport pressure to the gas;

an extraction subsystem for extracting evaporated dampening fluid from a region proximate said dampening fluid layer;

said reservoir being communicatively coupled to said extraction subsystem for collecting and recycling evaporated dampening fluid extracted from said region proximate said dampening fluid layer for reuse by said dampening fluid subsystem;

a thickness sensor for determining the thickness of said dampening fluid layer at a location following said gas directing nozzle;

a barrier structure configured to be disposed between said gas directing nozzle and an optical patterning subsystem in the direction of travel of said imaging member to prevent evaporated dampening fluid from settling on said dampening fluid layer following evaporation and to otherwise prevent disturbing the dampening fluid layer between the point of evaporation and the optical patterning subsystem; and a controller communicatively coupled to said thickness sensor and said valve such that said thickness determined by said thickness sensor is compared to a target thickness and in response to said comparison said controller provides a signal to said valve to adjust the flow of said gas to said nozzle to thereby control the extent of evaporation of said dampening fluid.

14. The subsystem of claim 13, wherein said gas source is selected from the group consisting of: a gas generator, and a gas storage container.

* * * * *